US009106986B2

(12) United States Patent
Shen et al.

(10) Patent No.: US 9,106,986 B2
(45) Date of Patent: Aug. 11, 2015

(54) HEADPHONE WITH INTEGRATED RECEIVER

(71) Applicants: Haoye Shen, San Diego, CA (US); Yuefeng Jiang, Poway, CA (US)

(72) Inventors: Haoye Shen, San Diego, CA (US); Yuefeng Jiang, Poway, CA (US)

( * ) Notice: Subject to any disclaimer, the term of this patent is extended or adjusted under 35 U.S.C. 154(b) by 306 days.

(21) Appl. No.: 13/853,762

(22) Filed: Mar. 29, 2013

(65) Prior Publication Data

US 2013/0259256 A1 Oct. 3, 2013

Related U.S. Application Data

(60) Provisional application No. 61/617,503, filed on Mar. 29, 2012.

(51) Int. Cl.
*H04R 1/10* (2006.01)
*H04R 3/00* (2006.01)

(52) U.S. Cl.
CPC .. *H04R 3/00* (2013.01); *H04R 1/10* (2013.01); *H04R 1/1008* (2013.01); *H04R 1/1016* (2013.01); *H04R 2420/07* (2013.01)

(58) Field of Classification Search
CPC ..... H04R 5/033; H04R 1/1041
USPC ..... 381/74
See application file for complete search history.

(56) References Cited

U.S. PATENT DOCUMENTS

| | | | | |
|---|---|---|---|---|
| 6,980,165 | B2 * | 12/2005 | Yuasa et al. | 343/718 |
| 2004/0204168 | A1 * | 10/2004 | Laurila | 455/569.1 |
| 2005/0266875 | A1 * | 12/2005 | Yegin et al. | 455/552.1 |
| 2010/0245585 | A1 * | 9/2010 | Fisher et al. | 348/164 |

* cited by examiner

*Primary Examiner* — Simon King
(74) *Attorney, Agent, or Firm* — Donn K. Harms

(57) ABSTRACT

A portable headset device worn in an as-used position on the head of a user, which has an RF Receiver, configured to receive media in the form of electronic audio and video RF transmission, from local TV and Satellite broadcasts, and communicate an audio feed to speakers on the headset and concurrently communicate a video feed to an electronic device having a display for a concurrent viewing a depiction of the video feed relating to the audio feed being listened to on speakers of said headset.

13 Claims, 2 Drawing Sheets

HEADPHONE WITH INTEGRATED RECEIVER

This Application Claims Priority to U.S. Provisional Patent Application Ser. No. 61/617,503 filed on Mar. 29, 2012 and is included herein in its entirety by this reference thereto.

BACKGROUND OF THE INVENTION

1. Field of the Invention

The present invention relates to the integration of over-the-air broadcasting of mobile digital television signals with user video and audio display devices. More particularly it relates to a portable headset or headphones, which counter intuitively receive off air audio and video broadcasts, and provide the interface for reception of such over-the-air television and media signals, which are communicated to a smartphone or computer or tablet in a format employable by the attached device and video display. The device thus provides earphones engageable to any handheld or other device having an audio output and concurrently provides audio and video signals from local RF broadcasts, to an engaged device in a digital formats playable by the attached device.

2. Prior Art

Portable communication devices such as headphones, headsets, and other head-worn sound reproduction devices in past years employed a cable, and more modernly employ a wireless communication from a BLUETOOTH enabled audio player to receive close range RF signals and provide sound to the user communicated from the attached device itself. Such devices include radios, cellphones, a television, smart phone, or large or small computer or the like. These head worn devices conventionally have ear covering speakers, and can have microphones such as those employed for use with a cell phone. On occasion, headphones have also included small video displays, to reproduce a video feed communicated from the connected device providing all of the media signal to the headphones.

Conventionally, it is known in the art that wireless headphone devices are employed with portable or household music players, mobile phones, televisions, and personal computers and the like and employ an RF or optical signal transmitted to the headphone, from the device to which the headphone functions as a slave. In use, as noted conventional headphone devices employ a wired or wireless means to communicate with the corresponding host electronic device in order to receive the device's broadcast audio signal and then reproduce it in the headphone.

U.S. Pat. No. 6,980,165 to Yuasa et. al. teaches an integrated antenna and headphone system employing radio circuitry to receive FM radio broadcasting and which functions as its own master and slave. This invention is substantially similar to many conventional headset devices which have an antenna and radio receiver, which communicates the sound to the speakers of the headphone and eliminates the need for a host or master device.

US Pub. No. 2005/0266875A1 to Yegin et. al. teaches a headphone assembly employing a satellite radio receiver with a integrated antenna which is configured to receive satellite digital audio radio signals from the satellite, and reproduce them on the speakers of the headphone assembly itself, again teaching a solitary headset providing its own audio.

US Pub. No. 2010/0245585A1 to Fisher et. al. discloses a hands free headset receiver, which function as a GPS enabled cellphone, capable of cellular network communications using an onboard video display and audio speakers to operate as a smart phone. The Fisher device also teaches the use of the headset, in the conventional fashion, as a slave to a radio, cellphone, game, or tv, for use to reproduce single feed of audio and video signals generated by the host device, in the attached headphone.

In reference to these and other similar prior art headset devices, they operate in a conventional deployment of such head mounted sound and/or video devices in that they reproduce the single audio and video feed from a host. Such devices, for instance, include a small television transmitting sound or a mobile phone transmitting sound to the user headphones.

For example, a mobile phone is configured to receive radio signals related to a phone call or a single stream of media streaming from a wireless broadcasting tower or satellite. In turn, through wireless communication, the mobile phone will then broadcast the received single feed of audio content to the headset or headphone device to act as the slave device to reproduce the sound or video. As one could imagine, the quality of the audio or video content received by the headphone device, is directly limited by the single feed quality provided by the host device, such as the antenna, reception quality, transmitting quality, battery power, operating system, and other factors related to the mobile phone or other host device providing a signal for play by the headphone. Often the transmitted signal of the feed of the audio from the host device is accomplished in an omnidirectional manner. Not only does the headset have only a single feed signal to reproduce as a slave, the reproduction quality on the headphone, may further derogate due to the reception quality of the host signal to the headphone or headset.

Current host devices such as music players, mobile phones, televisions, and personal computers may also have limitations in the media stream available, due to the network requirements and frequency ranges they are compatible to transmit/receive. Modern mobile telecommunication includes, but is not limited to, cellular, wi-fi, and BLUETOOTH frequencies and single feed cellular broadcasts of a single source channel of individual digital television signals. Transmission and reception in all or any combination of these frequencies by a single mobile phone or other host video display device requires substantial amount of computing power and can slow or otherwise limit the host device.

Further, since conventional headphone devices are configured to receive a single feed of audio signals from a host device, should a user has multiple host devices, which broadcast and receive signals at different frequencies, the user may have to obtain separate headset devices which are specifically employable with each host. Further, because host devices are generally band-specific and provide a single feed of a network or host generated media signal, users may need a plurality of host devices to receive the type and quantity of media they wish. This can be quite costly and may also be a nuisance to the user.

Still further, most video display enabled devices employed by most users, are limited to a very narrow range of broadcast signals they receive and consequently the video they may display and audio they may provide, without hardware and antenna and software upgrades and band and frequency interface components. For instance, a smart phone cannot display the dozens of local television signals from RF over-the-air transmissions from a local stations. Instead, if a smart phone is to display a television signal, it is a single stream of data communicated over a network, using WiFi or cellular broadcasts and software to receive the single digital signal and convert it for a single channel of play. Consequently, the display of the smartphone, which may be capable of depicting one of the dozens of free local off-air television programs being broadcast concurrently, is relegated to a single media feed from a computer network in the frequencies in which the phone operates, generally at a subscription cost, as well as charges for use of the cellular system time, if done portably.

A pad or laptop computer may have a large and attractive video display, however conventional pad and laptop computers must also either be adapted to receive television signals from over-the-air broadcasts by the addition of software specific, computer specific, and cables. Thus, there is a significant cost for the hardware and software as well as a user expertise level in integrate the tuner and hardware with the single computer to which it is engaged.

The requirement for individual highly integrated hardware and software for computers, or the use of streaming single channel media over a subscription network, and especially a cellular network, renders the user's choice if they wish to receive and listen to free, over-the-air signals, both expensive and severely limited due to the choice between streaming digital single channel media or purchasing expensive equipment for each computer. Further, if the privacy and improved sound of a headphone is desired, the user still must purchase and engage the headphone to the host device providing the audio feed.

As such there is a continuing and unmet need for an improved device for reception of the multiple concurrent over-the-air broadcasts, which are available to users in most towns, and which does not require adding both equipment and software, and headphones, to receive any of the plurality of broadcast television and radio stations, and listen to them on headphones while viewing the video on the host device. To eliminate the need for and multiple cost of expensive device-specific hardware which uses hard to load and device-specific software, for each device, such a device should interface with any computing or game device having a display, and, provide both headphones to high quality audio, as well as a digital or analog audio and video stream in a common electronic format, thereby allowing use of the video display of the attached device, to provide the video. Because of the small size of most computers and Smartphones, their loudspeakers lack acoustic reproduction ability which is required for pleasurable listening of media. Consequently, in addition to providing the audio and video signals to a slave device such as a cell phone, such a device ideally would be a headset or the headphone device itself, to allow users to engage to any electronic component with at least a video input. Such allows for the communication of the video portion of the off-air broadcast to the slave device of the cell phone, smartphone, or computer, while employing the headphones for audio reproduction of high quality sound which lacks in the slave devices. Most such video display capable devices do have an auxiliary input which accept video signals in a common standard. Thus, a headphone having an off-air receiver for concurrent reception of any of the local broadcast television stations, can act as the host for both the audio and video, and communicate one or both of the audio or video for reproduction by the slave cell phone, smartphone, or pad or laptop.

In this fashion, employing the device herein, users may have headphone quality audio on any electronic device they own, which has an audio output. They can also have over-the-air broadcasts of dozens of free television channels on the same devices, without the need to buy hardware and software for each separate device. Such broadcasts may be those from commercial television stations, or from cellular based digital broadcasting stations.

In operation, the head worn device should be adapted to receive at least, the dozens of RF broadcasts of local television and radio and provide such signals to any of their slave devices. Additionally, the device herein can be configured to also receive from such sources as cellular towers, digital television broadcasts on a cellular or area-wide system, wireless modems, local WiFi or BLUETOOTH broadcasts, satellite, and other wireless transmissions, and to produce headphone quality sound for the user and communicate at least the video portion, in a useable signal, to any local available screen of a receiving device such as a TV, pad computer, laptop, mobile phone, PC, or the like.

In addition, such a head worn sound reproduction device should provide a common means to communicate the video signal, to any available video screen adapted to receive a video signal from a video signal generating device, thereby providing a common manner to receive and display such signals, and concurrently use headphones, with no cost for individualized hardware and software for each individual electronic device the user has. Still further, to eliminate excessive RF noise, and to insure even easier use and connection and an uninterrupted video signal, and hence a video display in time to match the sound generated by the head worn device, such a device should employ means for a directional signal broadcasting, to the intended video device, to insure high quality video and/or audio signal reception to the receiving video display device.

SUMMARY OF THE INVENTION

The device herein disclosed and described provides a solution to the shortcomings in prior art and achieves the above noted goals through the provision of a portable headset device having integrated TV and digital tuner, antenna, and an RF or optical transceiver. The headset device preferably includes an audio speaker component which can be headphones, ear bud, headband, hat, eyeglasses, or the like which will provide the audio to match the video communicated to a local display.

In a particularly preferred mode the antenna is an antenna having omnidirectional television and digital RF reception capability, however in other modes, the antenna can adapted for direction such as satellite or other wireless communication, or can be of sufficient wideband reception ability to cover multiple broadcast bands of concurrent live RF broadcasts. The transceiver is preferably also configured for WiFi, BLUETOOTH, infrared or other optical, or cellular communication.

The head worn device is configured to receive incoming audio and video signals from sources such as over-the-air TV broadcasts, digital television broadcasts from local or cellular sources be they encoded or simple repeaters of commercial stations, or other such locally available media broadcasted signal. Operation of an optical or RF transmitter or transceiver allows the head worn device to re-broadcast the received video and/or audio or both signals, in a useable electronic format, to a host device having at least a display, such as a mobile smart phone, tablet computer, laptop computer, television, personal computer, or other suitable host device having a display capable of reproducing the video broadcast from the head worn device.

A distinct advantage is found over prior art in that the headset device herein, operates as its own host for video and audio, independently of the video display device, simply providing a means for a video display. This advantage is furthered by eliminating the current need for custom hardware and software for each individual host device to receive over-the-air broadcasts and instead use a single headphone device engageable to multiple slave devices with video displays. The user can thus interface with any local video display configured to receive the broadcast video signal from the headphone device. Many such devices have a common auxiliary input and common electronic standards to enable the device herein, to act as a single hose, to easily communicate with a plethora of video devices already in the installed base. Thus, a local smart phone or laptop or pad computer, is therefor not limited by the lack of a TV antenna, operating system, software, or receiver and other factors directly related to such a video display device receiving and displaying over-the-air broadcasts.

In a particularly preferred mode the disclosed headset device receives audio and video signals from an over-the-air television broadcasts from one or a plurality of sources, and transmits (or re-broadcasts) at least the video signal to a mobile phone or pad computer via an optical, or RF transmitter such as a WiFi or BLUETOOTH transmitter. As such, unlike conventional headphones that are at the mercy of a single local video display device, the user of the device herein, can enjoy the audio privacy of the headset while further empowering the user with the convenience of using any local video display available and configured for a simple RF or optical or in some cases corded reception of at least the video from the headset.

In addition, the headset device may include a microphone and can be configured with the mobile phone for wireless communication during a received phone call by the mobile phone as well as for other features. As such the headset device does not need to be taken off by the user or disconnected from the wireless communication from the mobile phone device during a phone call.

Further, in yet another preferred mode of the invention, the device may employ a removably engageable hardwired connection for direct communication with a television, mobile phone, tablet, or other device through a common standard, from a group including, composite video, VGA or HDMI. The device herein with one or all of these output modes, will provide the host device for video signal for any electronic devices with one of these inputs, and such is anticipated.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and mayor may not be present. By "consisting essentially of" or "substantially" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and mayor may not be present depending upon whether or not they affect the activity or action of the listed elements. It is an object of the invention to provide a portable headset device capable of RF off-air or over-the-air analog and/or digital television signal reception from both commercial broadcasts as well as localized digital broadcasts and which has the antenna, and RF or optical transmitter or output, to allow employment of any local video display device to display headset provided video.

It is another object of this invention, to allow users with multiple electronic devices with video display capability, to have one input device for video signals for off-air broadcasts which will interface with all their electronic devices, without the need for specialized hardware and/or software for each device.

It is another object of the invention to provide a headset device which receives over-the-air TV broadcasts and allows the use of any local video display which uses one of the widely employed common input standards for reception of at least the video portion of the signal.

It is still another object of the invention to provide directional RF or optical transmission to insure optimal video display and avoid electronic interference with others.

It is another object of the invention to provide means for WiFi or BLUETOOTH or optical wireless communication with any so configured video device.

BRIEF DESCRIPTION OF DRAWING FIGURES

FIG. 1 shows a view of a particularly preferred mode of the headset device being substantially like headphones have an antenna, RF or optical transceiver or transmitter, RF tuner, and optionally including a microphone.

FIG. 1*a* shows a view of another preferred mode of the headset device herein, shown as a smaller earpiece headset.

DETAILED DESCRIPTION OF THE PREFERRED EMBODIMENTS OF THE INVENTION

Figure 1:
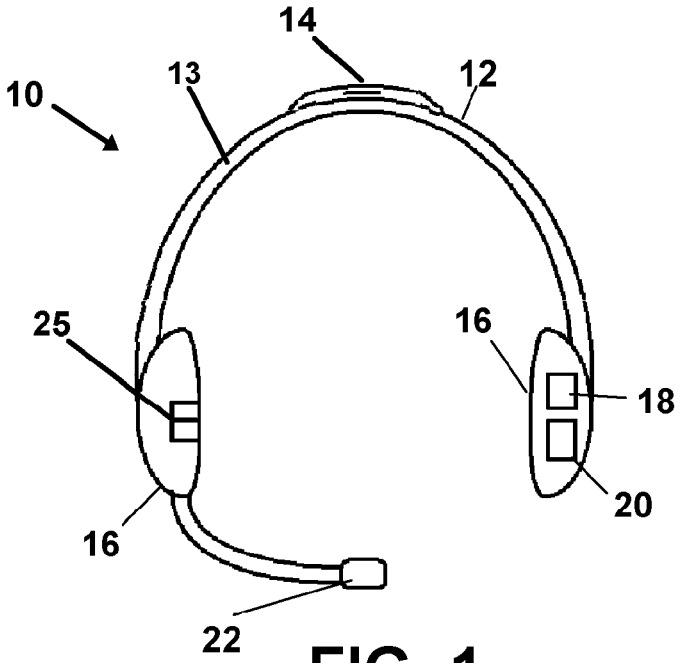
Figure 2:
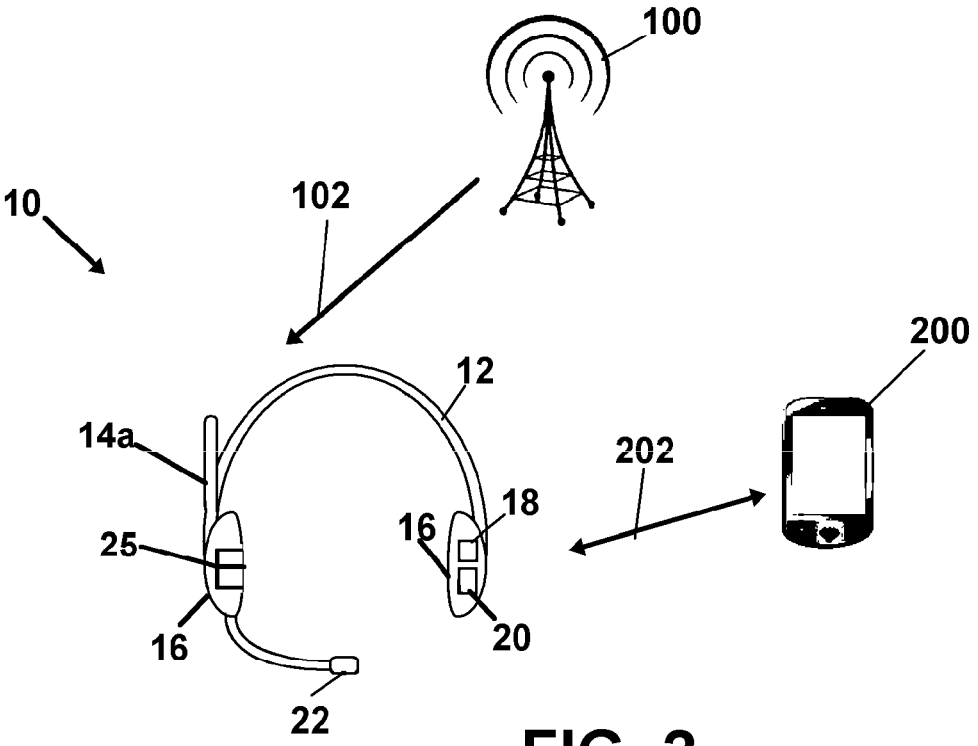
FIG. 2 shows a schematic diagram of the preferred communication between the device, and an off-air or over-the-air broadcast such as a typical over-the-air TV broadcast tower, using the video display of a local video enabled device such as a mobile phone.
Figure 3:
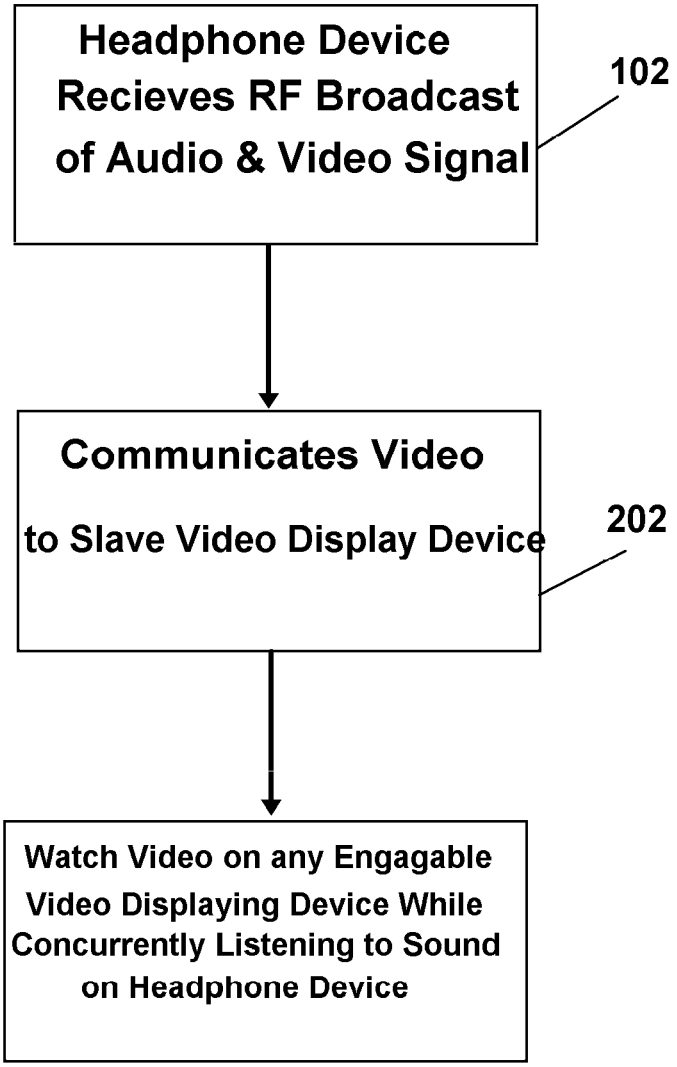
FIG. 3 depicts a system diagram of one mode of employment of the device and method herein for concurrent viewing of video from a receiver in the headphones, while listening to the audio from the same receiver using the headphones.

Now referring to drawings in FIGS. 1-3, wherein similar components are identified by like reference numerals, there is seen in FIG. 1 a view of a particularly preferred mode of the device 10 comprised of headphones 12 having an integrated and preferably wideband antenna 14. The antenna 14 in this mode, is a microstrip or patch antenna or similar planar configured antenna, located on the headphones 12 to locate at the peak of a user's head, when the headphones 12 are worn by the user, in an as-used position with the curved flexible member 13, engaged over the top of a user's head, and positioning the respective audio reproduction components, such as speakers 16 engaged over or abutting one or both ears of the user.

Locating an omnidirectional antenna 14 configured for off-air or over-the-air broadcast RF signals from commercial television stations in the digital HDTV frequencies between 54 MHz to 1002 MHZ provides, in a position on the flexible member 13 to be at the peak of the user's head, has been found to provide a current best point for reception of the audio signal, and especially the video signal. Locating an omnidirectional wideband antenna configured and operating in a mode similar to that taught in U.S. Patent Application Publication US 2012/0200469, which is made part hereof, helps significantly to maximize the received signal from all directions around the user, and especially to prevent video pixelation which occurs with a weak or changing signal strength. The antenna 14 with an unobstructed positioning shown, can also be configured to receive the stronger broadcast commercial Satellite RF signal of digital TV and audio.

As seen in FIG. 1, a position on the flexible member 13 at a central area between the speakers 16 will position the antenna 14 at the apex or peak of the head of the user when the headphones 12 are placed on the head in an as-worn position. In addition to an unobstructed positioning for surrounding terrestrial TV broadcasts, and overhead satellite broadcasts, this positioning works well for positioning a ground plane for use in combination with the antenna 14 and in most all cases to maximize signal reception for local terrestrial and Satellite RF broadcasts. As such, positioning the antenna 14 on the flexible member 13 to place the antenna 14 at in an unobstructed position for reception from surrounding broadcasts on all sides of the user, is preferred to maximize reception and minimize pixelation of the video received. However, in some cases the antenna 14*a* positioning shown in FIG. 2, may also work reasonably and is considered within the scope of this invention since a primary purpose is the provision of video signals to a large plurality of devices while also providing audio though head mounted speakers 16 and the antenna 14*a* positioning to the side of the head will in many cases perform well to provide the video signal needed to the slave receiving device 200.

The receiver such as an HDTV receiver and tuner component 20 is operationally engaged to the antenna 14 or 14*a* and is configured for receiving over-the-air TV broadcasts such as commercial broadcasts from central towers as well as encoded and un-encoded mobile digital television broadcasts. However in other modes the antenna 14 when situated at the peak of the user's head, can be wide band and/or also configured for receiving overhead satellite RF transmissions of media such as those from high power transmitters of DIRECTV. In this fashion a primary object of the device 10 herein, to receive and communicate the video signal from the terrestrial or satellite RF broadcast television to a slave receiving device 200 for use in combination herewith, provide a viewable video portion of the received RF broadcast along with concurrent provision to the user of the high quality audio from the head engaged speakers 16.

In accordance with at least one preferred mode the antenna 14 is especially well adapted to receive over-the-air TV broadcast audio and video RF signals, in digital format, and has an onboard receiver and processor engaged to a transmitter which rebroadcasts the signals, in a format employable by a local video display, to any local device having a video screen and configured to receive the optical or RF video signal from the headphones 12.

Such devices would include for instance a smart phone having a video display, or other video display device and the ability to receive the RF or optical transmission and use it to display the video being broadcast by the headphones. It must be noted that although not shown the device 10 will include additional circuitry and/or processors in order to properly run and communicate between the components and to allow channel selection and communication of at least the video signal of the received media and the relative actions of the device 10. Such components are well known in the art and therefor are anticipated within the scope of this patent.

The device 10 preferably additionally includes at least a receiver having a TV tuner component 20. The component 20 can be a conventional tv tuner on a circuit board capable of communicating with an antenna and converting and outputting the received signal to an audio and video portion, or it may be a software based receiver to perform the same task. The video portion of the signal from the tuner component 20 once received, is rebroadcast in a useable electronic format in a preferably wireless communication, to any local video enabled device capable of receiving the wireless broadcast and rendering the video portion of the signal on a video display. Communication of the video to the local device is accomplished via an RF or optical transmitter or transceiver 18 which is in operative communication with the other circuitry of the device 10.

The transceiver 18 can be configured for infrared or other optical transmissions or with RF such as wi-fi or Bluetooth wireless communication. Using projection or broadcast antennas adapted to the task, the transmission to the local receiving video device can be made directional for improved reception quality at the video screen providing device. The headphone 12 additionally includes at least one audio reproduction device, such as speakers 16, which provide a means to reproduce a receive audio portion of the over-the-air signal for the user when the device 10 is in a conventional as worn position.

Further, as mentioned, the device 10 may optionally include a microphone 22 which may be operatively employed during wireless communication with a smart phone or other host device as needed.

Figure 1A:
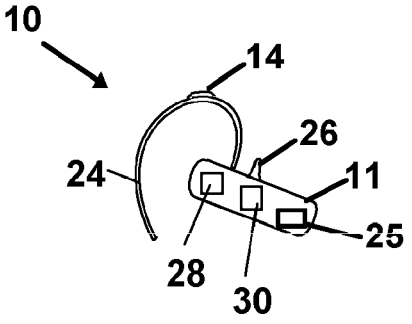

FIG. 1*a* shows yet another preferred mode of the device 10 comprising an earpiece type headset 11 having integrated antenna 26, transceiver 28, and tuner 30. As is commonly known in the art the earpiece headset 11 has an ear engaging portion 24 providing the user with a means for secured engagement to their ear.

It must be noted that it is within the scope of the invention that the device 10 can be any known type of headset device and is not to be considered limited by the depictions set forth. As such one skilled in the art will appreciate that the depiction of a headphone 12 and earpiece headset 11 are provided merely as examples of possible headset configuration while other forms or types known in the art may also be readily employed, and are anticipated. It is of course the use of the headphone and headset as the receiving device, and common communication to any local video enabled device which forms the main object of the invention.

FIG. 2 gives a brief schematic diagram of the preferred communications between the device 10, a broadcast tower 100, and video display enabled slave receiving device 200. In a preferred mode the broadcast tower 100 is an over-the-air TV broadcast tower, however in other modes the tower 100 can be a satellite, modem, or other broadcast source of media having audio and video portions. Further, the slave receiving device 200 can be any local device adapted to receive the signal broadcast from the headphone and reproduce the video on a screen such as a smart phone, mobile phone, tablet computer, laptop computer, PC, television, or the like.

As is shown, the antenna 14 of the device 10 is configured to receive audio and video signal 102 from a broadcast tower 100 or other media broadcast source. The tuner 20 will process the signal 102 for communication of at least the video portion in an electronically or digital useable format, to a slave receiving device 200.

The video signal with very wide use and acceptance is a composite signal which is generally communicated using a coaxial cable and RCA type plug. Another widely used current transmission signal for video is HDMI via a cable having standard ends for engagement in the port of both the device 10 and the slave receiving device 200. A third popular format would be VGA which is also conventionally communicated over a cable with multiple pins. Consequently, the device 10 may have one or a plurality of cable engageable ports 25 from a group including Composite, VGA, and HDMI at a minimum, to allow a plug in cabled video signal communication 202 of at least a video signal displayable on a video screen of a slave receiving device 200. As the male and female engageable ports 25 and cable configurations for VGA, Composite, and HDMI are well known in the art, such are not shown herein.

In the alternative, or for wider engagement to more devices, a combination with the ports 25 of the optical or RF transmitter or transceiver component 18 can also provide the video signal communication 202 and would be provided by the transceiver 18. This transceiver 18 can be configured for infrared, or WiFi or BLUETOOTH to communicate a video signal communication 202 wirelessly to a slave receiving device 200 enabled to receive such in that fashion.

In all modes of the device, one headphone 12 device configured as herein, will provide a video signal communication 202, of off-air or over-the-air television signals, from local broadcasts, to any of a plurality of different electronic slave receiving devices 202, without any need to add any hardware to the slave receiving devices 202. This allows one headphone device 10 as herein, to provide the enhanced audio from adjacent-the-ear speakers 16 to users, who may use any of a plurality of their handheld or other slave receiving devices 202, without any hardware and software additions to each slave receiving device 202, as is currently required, to watch the video from the video signal communication 202. The user thus need not buy and install the differing hardware and software to each slave receiving device 202 in order to watch local off-air TV thereon, and can also listen to radio, and other local broadcasts received by the wideband antenna 14 using the device 10 herein.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed:

1. A portable headset device for engagement to an as-used position on the head of a user, comprising:

a flexible member configured for an engagement to said as-used position;

an RF Receiver, engaged with said flexible member, said RF Receiver configured to receive media in the form of electronic audio and video RF transmission, and communicate an audio feed and a video feed therefrom;

an antenna in operative electronic communication with said RF Receiver, said antenna configured to receive said electronic audio and video RF transmissions from broadcasts thereof and communicate said electronic audio and video transmissions said RF Receiver;

a speaker engaged with said flexible member, said speaker in an electronic communication with said RF Receiver to receive said audio feed therefrom, and reproduce sound;

electronic means for communicating said video feed, to one or a plurality of electronic devices, remote to said flexible member, having a video display and a means for to receive said video feed; and said video display providing a visual depiction of said video feed to said user, concurrent with said speaker reproducing said sound relating to said visual depiction, whereby said user can employ said headset device with any of said plurality of electronic devices available to said user, to view said video of said media broadcast in RF transmission while concurrently listening to said sound on said speaker, without any additional hardware engagements to said electronic device.

2. The portable headset device of claim 1, additionally comprising:

said electronic means for communicating said video feed, to one or a plurality of electronic devices, is a cable in electronic communication between a fitting engageable to a first port on said headset, and a second fitting engageable to a second port on said electronic device.

3. The portable headset device of claim 2, additionally comprising:

said first fitting being one of a group of fittings configured to engage with said first port and communicate a said video feed, said group of fittings including composite video fittings, VGA fittings, and HDMI fittings; and said first fitting being one of a group of fittings configured to engage with said second port and communicate a said video feed, said group of fittings including composite video fittings, VGA fittings, and HDMI fittings.

4. The portable headset device of claim 1 wherein said electronic means for communicating said video feed comprises:

a wireless transmitter engaged with said headset, said wireless transmitter broadcasting a wireless transmission of said video feed; and a wireless receiver in operative engagement to said electronic device, said wireless receiver configured to receive said wireless transmission of said video feed, and communicate it to said electronic device for operative communication to said video display to render said visual depiction thereon.

5. The portable headset device of claim 1 further comprising:

said headset having a said flexible member extending between two speakers;

said antenna engaged at a central portion of said flexible member, said central portion being situated at a peak unobstructed position on said user's head, when said headset is in said as-used position; and said antenna in said peak unobstructed position, providing an unobstructed receipt of said electronic audio and video RF transmissions from said broadcasts at any incoming angle.

6. The portable headset device of claim 2 further comprising:

said headset having a said flexible member extending between two speakers;

said antenna engaged at a central portion of said flexible member, said central portion being situated at a peak unobstructed position on said user's head, when said headset is in said as-used position; and said antenna in said peak unobstructed position, providing an unobstructed receipt of said electronic audio and video RF transmissions from said broadcasts at any incoming angle.

7. The portable headset device of claim 3 further comprising:

said headset having a said flexible member extending between two speakers;

said antenna engaged at a central portion of said flexible member, said central portion being situated at a peak unobstructed position on said user's head, when said headset is in said as-used position; and said antenna in said peak unobstructed position, providing an unobstructed receipt of said electronic audio and video RF transmissions from said broadcasts at any incoming angle.

8. The portable headset device of claim 4 further comprising:

said headset having a said flexible member extending between two speakers;

said antenna engaged at a central portion of said flexible member, said central portion being situated at a peak unobstructed position on said user's head, when said headset is in said as-used position; and said antenna in said peak unobstructed position, providing an unobstructed receipt of said electronic audio and video RF transmissions from said broadcasts at any incoming angle.

9. The portable headset device of claim 5 further comprising:

said audio and video RF transmissions including one or a combination of audio and video RF transmissions from a group including local television RF transmissions, and satellite television RF transmissions.

10. The portable headset device of claim 6 further comprising:

said audio and video RF transmissions including one or a combination of audio and video RF transmissions from a group including local television RF transmissions, and satellite television RF transmissions.

11. The portable headset device of claim 7 further comprising:

said audio and video RF transmissions including one or a combination of audio and video RF transmissions from a group including local television RF transmissions, and satellite television RF transmissions.

12. The portable headset device of claim 8 further comprising:

said audio and video RF transmissions including one or a combination of audio and video RF transmissions from a group including local television RF transmissions, and satellite television RF transmissions.

13. A method of employing the device of claim 6 comprising the steps of:

engaging said headset to said as-used position on said head;

engaging said first fitting of said cable in said first port;

engaging said second fitting of said cable in said second port located upon a said electronic device; and listening to said sound on said speakers of said headset while concurrently watching said video depiction of said video feed upon said electronic device.

* * * * *